US009242183B2

(12) United States Patent
Nagai et al.

(10) Patent No.: US 9,242,183 B2
(45) Date of Patent: Jan. 26, 2016

(54) TOY

(71) Applicants: TOMY COMPANY, LTD., Tokyo (JP); GANG CO., LTD., Tokyo (JP)

(72) Inventors: Tomohito Nagai, Tokyo (JP); Yasuhiro Yamasaki, Tokyo (JP)

(73) Assignees: TOMY COMPANY, LTD., Tokyo (JP); GANG CO., LTD., Tokyo (JP)

( * ) Notice: Subject to any disclaimer, the term of this patent is extended or adjusted under 35 U.S.C. 154(b) by 0 days.

(21) Appl. No.: 14/229,184

(22) Filed: Mar. 28, 2014

(65) Prior Publication Data

US 2015/0209683 A1 Jul. 30, 2015

Related U.S. Application Data

(63) Continuation of application No. PCT/JP2014/051542, filed on Jan. 24, 2014.

(51) Int. Cl.
*A63H 13/00* (2006.01)
*A63H 11/00* (2006.01)

(52) U.S. Cl.
CPC ..... *A63H 11/00* (2013.01); *A63H 2200/00* (2013.01)

(58) Field of Classification Search
CPC ..... A63H 7/04; A63H 7/06
USPC ..... 446/272, 274, 276, 277, 279, 280, 285, 446/286, 287, 292, 293, 457
See application file for complete search history.

(56) References Cited

U.S. PATENT DOCUMENTS 2,641,864 A * 6/1953 Villemejane ..... 446/293
2,668,391 A * 2/1954 Huard et al. ..... 446/287
3,010,252 A * 11/1961 Crawford et al. ..... 446/189
3,038,275 A * 6/1962 Curci ..... 446/293
3,083,504 A * 4/1963 Abbott ..... 446/291
3,484,988 A * 12/1969 Robbins ..... 446/355
3,566,533 A * 3/1971 Dunn ..... 446/287
3,568,363 A * 3/1971 Tanimura ..... 446/293
3,583,098 A * 6/1971 Bear et al. ..... 446/355
3,597,878 A * 8/1971 Iwasaki et al. ..... 446/355
3,665,644 A * 5/1972 Rapp ..... 446/355
3,913,261 A * 10/1975 Doe ..... 446/271

(Continued)

FOREIGN PATENT DOCUMENTS

JP 6-26992 4/1994
JP 7-299257 11/1995

(Continued)

OTHER PUBLICATIONS

Patent Abstracts of Japan, Publication No. 06-327843, Published Nov. 29, 1994.

(Continued)

*Primary Examiner* — Melba Bumgarner
*Assistant Examiner* — Joseph B Baldori
(74) *Attorney, Agent, or Firm* — Staas & Halsey LLP

(57) ABSTRACT

When one motor rotates a rotating disk, the rotating disk rotates a first moving body, and the rotating disk moves a second moving body from an initial position against a bias force of a bias unit, a protrusion of the rotating disk engages with allowance with a recess portion of the first moving body so that the rotating disk does not rotate reversely when the second moving body returns to the initial position. With this device, it is possible to move only either one of two moving bodies operated by one motor.

4 Claims, 18 Drawing Sheets

(56) References Cited

U.S. PATENT DOCUMENTS

| | | | | | |
|---|---|---|---|---|---|
| 4,047,325 | A * | 9/1977 | Yamazaki | 446/237 |
| 4,708,688 | A * | 11/1987 | Lee | 446/288 |
| 4,846,752 | A * | 7/1989 | Combs | 446/279 |
| 5,176,560 | A * | 1/1993 | Wetherell et al. | 446/175 |
| 5,232,390 | A * | 8/1993 | Brooks | 446/72 |
| 5,273,479 | A * | 12/1993 | Chang | 446/272 |
| 5,290,185 | A * | 3/1994 | Murakami | 446/334 |
| 5,727,982 | A * | 3/1998 | Hurt | 446/352 |
| 6,280,286 | B1 * | 8/2001 | Andrews | 446/334 |
| 6,736,693 | B1 * | 5/2004 | Lund et al. | 446/354 |
| 7,734,375 | B2 * | 6/2010 | Buehler et al. | 700/245 |
| 7,815,485 | B2 * | 10/2010 | Moothedath et al. | 446/352 |
| 8,500,512 | B2 * | 8/2013 | Hoeting | 446/355 |
| 8,747,179 | B2 * | 6/2014 | Nagai et al. | 446/330 |
| 2002/0193045 | A1 * | 12/2002 | Lee et al. | 446/330 |
| 2004/0198160 | A1 * | 10/2004 | Fong | 446/330 |

FOREIGN PATENT DOCUMENTS

| | | |
|---|---|---|
| JP | 2701121 | 10/1997 |
| JP | 2003-053050 | 2/2003 |
| WO | WO 2013/099299 | 7/2013 |

OTHER PUBLICATIONS

Patent Abstracts of Japan, Publication No. 07-299257, Published Nov. 14, 1995.

Patent Abstracts of Japan, Publication No. 2003-053050, Published Feb. 25, 2003.

English Abstract of WO 2013/099299, Published Jul. 4, 2013 (in publication).

* cited by examiner

TOY

CROSS-REFERENCE TO RELATED APPLICATION

This is a continuing application, filed under 35 U.S.C. §111(a), of International Application PCT/JP2014/051542, filed Jan. 24, 2014, the contents of which are incorporated herein by reference.

TECHNICAL FIELD

The present invention relates to a toy.

BACKGROUND ART

As a robot toy for play fighting, etc., there is known a toy in which one motor rotates a rotating disk to move two or more portions (for example, patent document 1).

In this robot toy, when the motor is driven to rotate, either one of a left or a right group consisting of a leg portion and an arm portion is pressed with the rotating disk according to a rotating direction of the rotating disk and the pressed group is moved at once.

PRIOR ART DOCUMENT

Patent Document

Patent Document 1: WO/2013/099299

DISCLOSURE OF THE INVENTION

Problems to be Solved by the Invention

According to the conventional robot toy, when the motor is driven to rotate, either one of a left or a right group consisting of a leg portion and an arm portion is moved at once according to the rotating direction of the rotating disk. Here, the rotating disk pressing the lever of the leg portion is pressed by the lever and rotates reversely when the rotating disk returns to the initial position with the bias force by the bias unit, and the arm portion also returns to its initial position. As described above, the leg portion and the arm portion move together, and it was difficult to move only the leg portion with the arm portion remaining in a state after movement.

SUMMARY OF THE INVENTION

An object of the present invention is to provide a toy where it is possible to move only one of two moving bodies which are moved by one motor.

In order to solve the above problems, according to a first aspect, a toy including a toy main body which includes a control device and a controller which remotely controls the toy main body through the control device, the toy main body includes:

a motor controlled by the control device to be able to rotate forward and reverse;

a first moving body in which a recess portion is formed and which is rotatable around an axis line extending in a vertical direction;

a second moving body which is provided in each side of left and right, and which is biased to an initial position side with a bias force of a bias unit; and a rotating disk which rotates around the axis line with the motor, wherein the rotating disk includes:

a contact portion which selectively presses either one of the left or right second moving body according to a rotating direction of the rotating disk to move the second moving body against the bias force of the bias unit; and a protrusion which engages to the recess portion and presses an edge of the recess portion with the rotation of the rotating disk to rotate the first moving body in a rotating direction of the rotating disk, and in the recess portion, the protrusion is fitted in a state to be able to move with allowance, and the protrusion does not press the edge of the recess portion until the second moving body returns to the initial position with the bias force of the bias unit after the second moving body moves against the bias force of the bias unit.

According to a second aspect, in the first aspect, the toy main body is a robot toy main body;

the first moving body is a torso portion attached rotatably to a hip portion;

left and right leg portions are attached to the torso portion;

each of the left and right leg portions is provided with a propulsion mechanism to kick a floor surface with a wheel so that the leg portion which kicked the floor surface moves forward, the mechanism including:

the second moving body including a lever which extends in a vertical direction inside the leg portion and which is supported rotatably by an axis at a middle portion so that a lower edge portion rocks in a front and rear direction;

the wheel provided in a lower edge portion of the lever;

a one-way clutch mechanism which locks the wheel when the lower edge portion of the lever rocks to the rear and which releases the lock of the wheel when the lower edge portion of the lever rocks to the front; and the bias unit which biases the lever in a direction that the lower edge portion of the lever rocks to the front, the contact portion presses an upper edge portion of the lever of either the left or right leg portion according to a rotating direction of the rotating disk and rocks the lever against the bias force of the bias unit; and the protrusion presses the edge of the recess portion with the rotation of the rotating disk and rotates the torso portion in a rotating direction of the rotating disk.

According to a third aspect, the second aspect further includes a reverse rotation prevention mechanism provided between an axis including the axis line and the torso portion to prevent reverse rotation of the torso portion in a position where the lower edge portion of the lever finishes rocking to the rear until the motor reversely rotates the torso portion.

According to a fourth aspect, the third aspect further includes:

a fixed gear; and a crown gear provided in the torso portion, the crown gear meshed to the fixed gear and rotating around the fixed gear while rotating itself with a rotation of the torso portion so that an arm portion moves by rotation of the crown gear.

According to a fifth aspect, the fourth aspect further includes, a crown gear engaging portion including one of a bump portion or recess portion in a perimeter direction of an axis portion of the crown gear; and an arm portion engaging portion provided in a base of the arm portion, the arm portion engaging portion fitting in the axis portion of the crown gear and including the other of the bump portion or the recess portion to engage to the one of the bump portion or the recess portion, wherein the number of the bump portion or the recess portion provided in the arm portion engaging portion is set to a same number as or a multiple number of a number of teeth of the crown gear.

According to a sixth aspect, in the fourth aspect or the fifth aspect, a sword can be attached to a hand of the arm portion.

According to a first aspect, the protrusion fits in a recess portion to be able to move with allowance and the protrusion does not press an edge of the recess portion while the second moving body returns to the initial position by bias force of a bias unit. Therefore, it is possible to prevent reverse rotation of the first moving body and to move only the second moving body while the first moving body is maintained in a state after moving.

According to a second aspect, the protrusion fits in the recess portion to be able to move with allowance and the protrusion does not press the edge of the recess portion until the lower edge portion of the lever rocks to the front with the bias force of the bias unit after the lower edge portion of the lever rocks to the rear. Therefore, it is possible to prevent reverse rotation of a torso portion, and it is possible to move only a leg portion while the torso portion is maintained in a state after moving.

According to a third aspect, a reverse rotation prevention mechanism is provided between the torso portion and an axis which is a center of rotation of the torso portion to prevent reverse rotation of the torso portion at a position where the lower edge portion of the lever finishes rocking to the rear. Therefore, it is possible to securely prevent the reverse rotation of the torso portion, and to move only the leg portion while maintaining the torso portion in a state after movement.

According to a fourth aspect, it is possible to move the arm portion when the torso portion rotates. Therefore, it is possible to achieve various movements.

According to a fifth aspect, it is possible to finely adjust the position of the arm portion. Therefore, it is possible to move the arm portion as the user desires.

According to a sixth aspect, the robot toy main body moves forward while swinging down or swinging up a sword. Therefore, it is possible to obtain an original robot toy.

DESCRIPTION OF EMBODIMENTS

Below, a robot toy of the present invention is described based on the illustrated embodiments.

Figure 1:
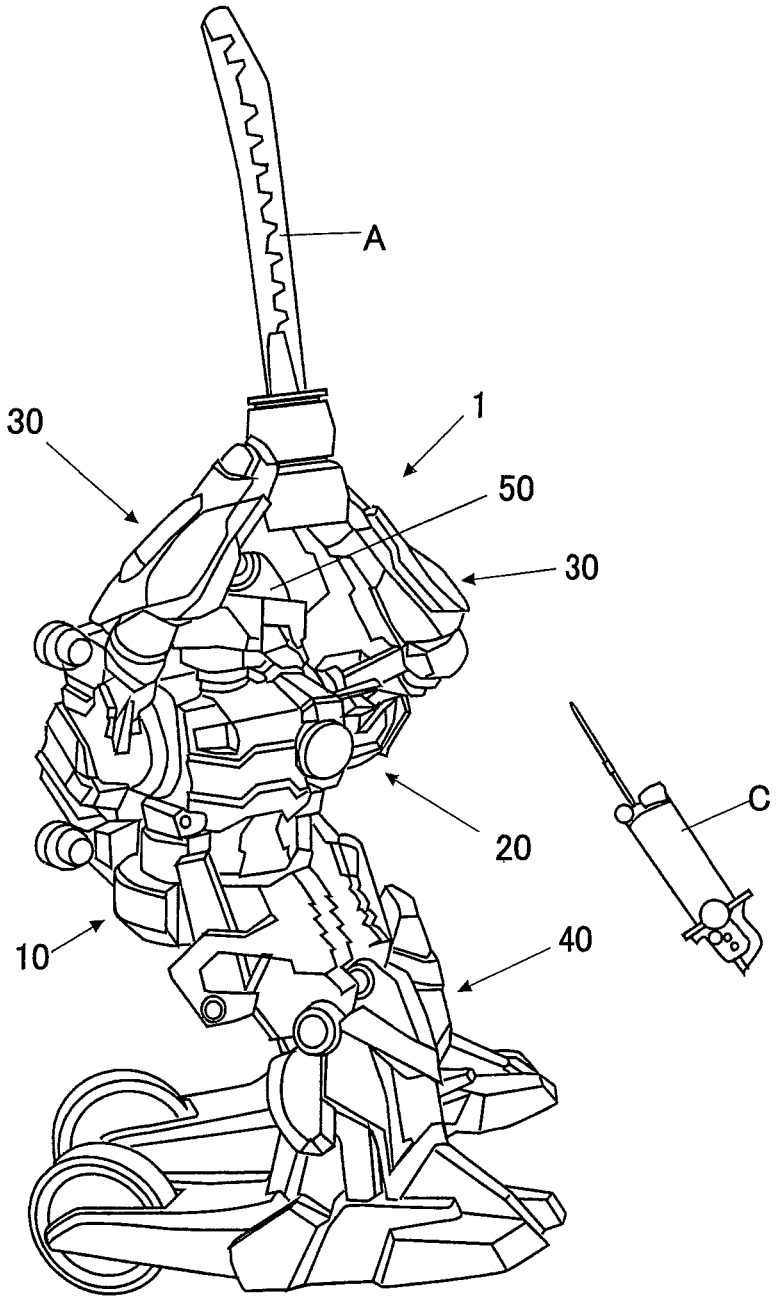
FIG. 1 is a perspective view showing an embodiment of a robot toy of the present invention.
Figure 2:
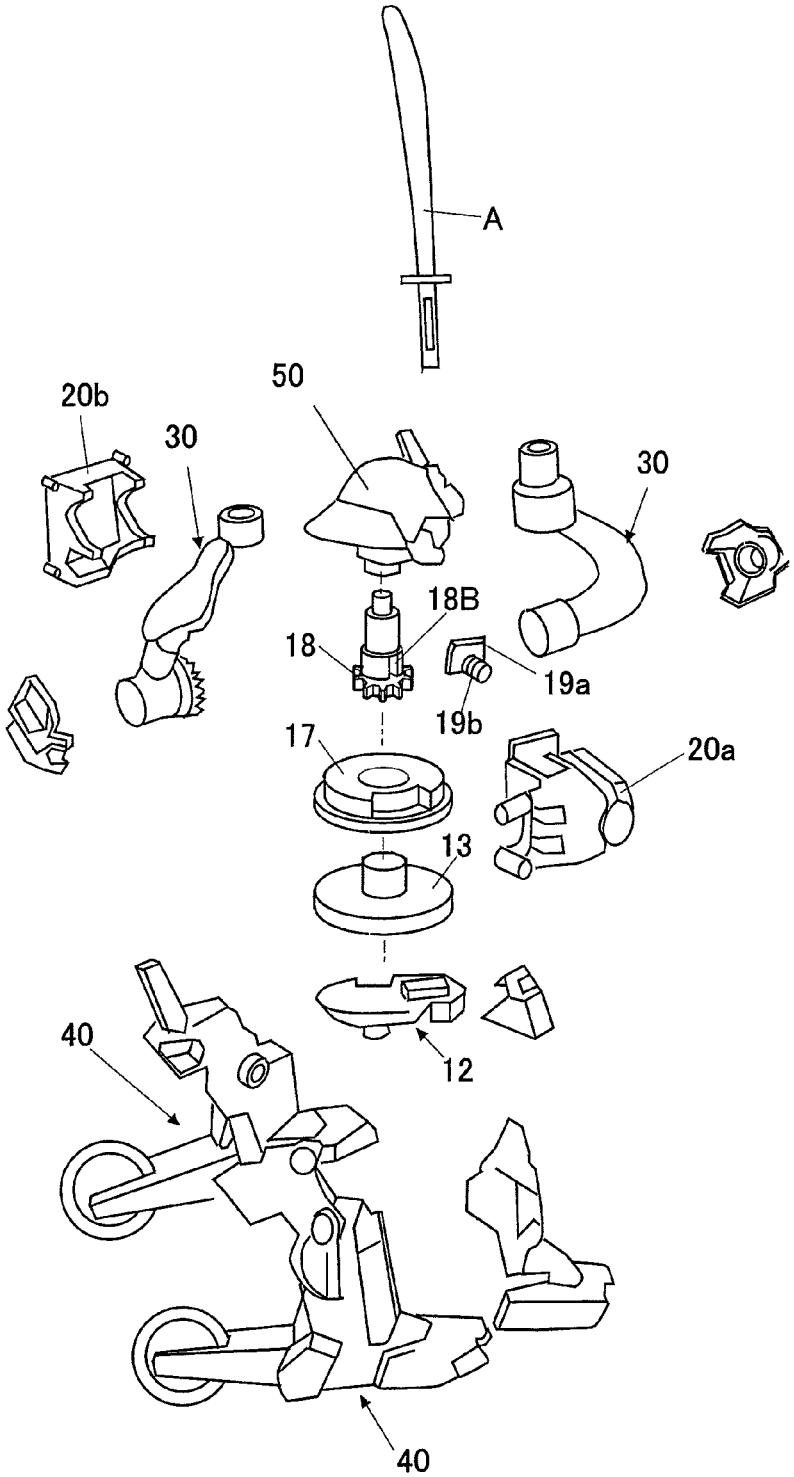
FIG. 2 is a conceptual exploded perspective view showing main components in a robot toy main body.
Figure 3:
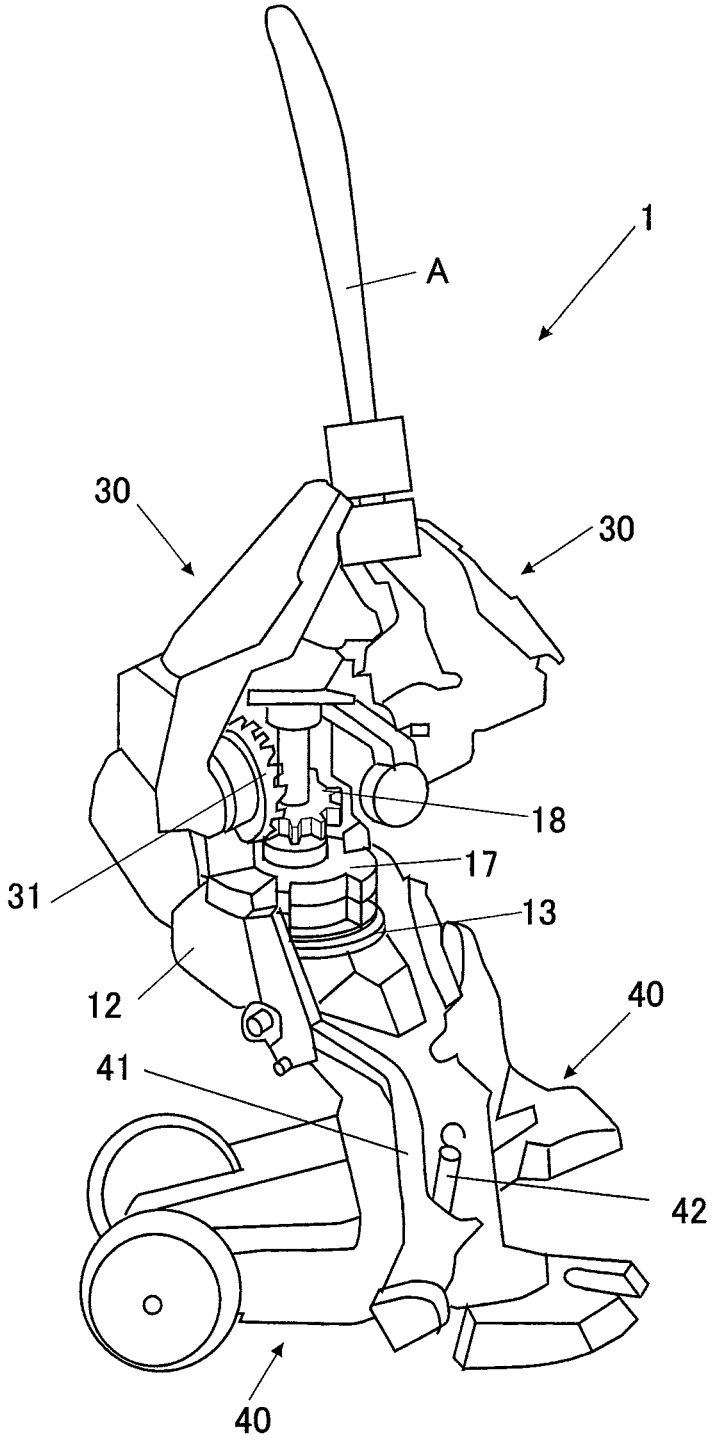
FIG. 3 is a conceptual perspective view showing a main portion cutting out a portion of a robot toy main body.

FIG. 1 is a perspective view showing an embodiment of the robot toy, FIG. 2 is a conceptual exploded perspective view of main components in a robot toy main body, and FIG. 3 is a conceptual perspective view showing a main portion with a portion of the robot toy main body cut out.

<Schematic Configuration of Robot Toy>

This robot toy includes a robot toy main body 1 and a controller C. In the robot toy main body 1, a torso portion 20 is supported rotatable in a horizontal direction with respect to a hip portion 10, and an arm portion 30 is supported rotatable in a vertical direction with respect to the torso portion 20. Further, in the hip portion 10, a leg portion 40 is supported to be able to move forward. The robot toy main body 1 is operated by remote control using the controller C.

<Outline of Operation of Robot Toy Main Body>

The outline of the operation of the robot toy main body 1 of the robot toy is described below.

FIG. 1 shows a state of the robot toy main body 1 where the torso portion 20 is twisted to the right side with respect to the hip portion 10 and a sword A is positioned above a right shoulder. In other words, the sword A is held high above in the upper right. In this state, when a user holds the controller C and makes a large swing from a high position to a low position, the robot toy main body 1 swings the sword A downward while twisting the torso portion 20 to the left side and also moves the right side leg portion 40 forward. In this case, since the robot toy main body 1 swings the sword A downward while twisting the torso portion 20 to the left side, viewed from the front of the robot toy main body 1, it is as if the robot toy main body 1 swings down the sword A diagonally from above the right shoulder to below the left leg.

Then, when the user makes a small swing with the controller C with the tip of the controller C pointing down, the robot toy main body 1 moves the right side leg portion 40 forward according to the number of times the user swings the controller C in a state in which the torso portion 20 is twisted to the left side and the sword A is maintained swung downward.

Then, when the user swings the controller C largely from the low position to the high position in a state where the torso portion 20 is twisted to the left side and the sword A remains swung downward, the robot toy main body 1 swings the sword A upward while twisting the torso portion 20 to the right side and moves the left side leg portion 40 forward. In other words, the robot toy main body 1 returns to the state of FIG. 1.

Then, when the user makes a small swing with the controller C with the tip of the controller C pointing up, the robot toy main body 1 moves the left side leg portion 40 forward according to the number of times the user swings the controller C in a state in which the torso portion 20 is twisted to the right and the sword A is swung upward.

While the above operation progresses, a head portion 50 of the robot toy main body 1 constantly faces forward.

<Details of Configuration of Robot Toy Main Body>

Next, the details of the robot toy main body 1 are described.

The outline of the torso portion 20 includes a front portion cover 20*a* and a rear portion cover 20*b* shown in FIG. 2. A power transmission mechanism is stored in the torso portion 20.

Figure 5A:
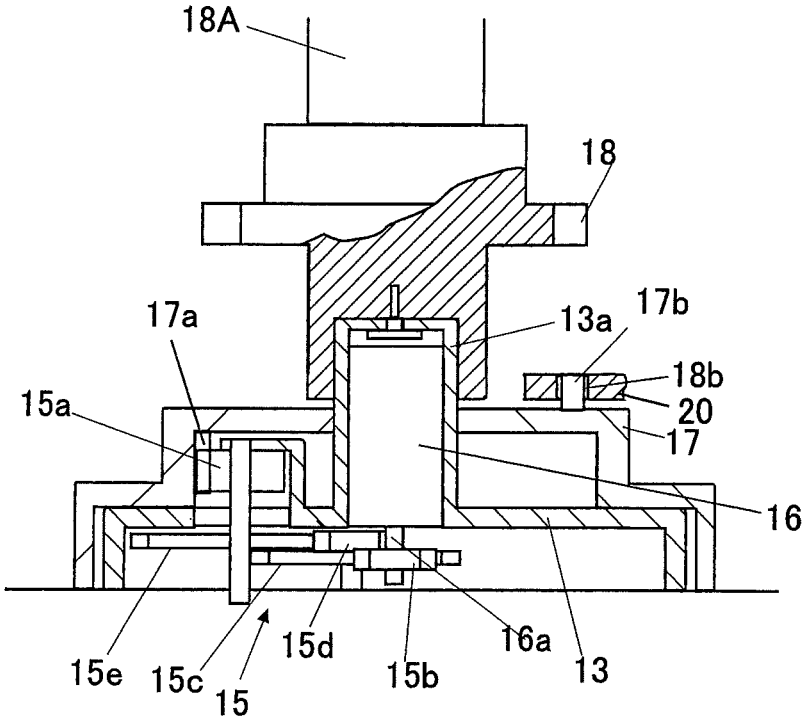
FIG. 5A is a cross-sectional view showing a portion of a power transmission mechanism of a robot toy main body.
Figure 5B:
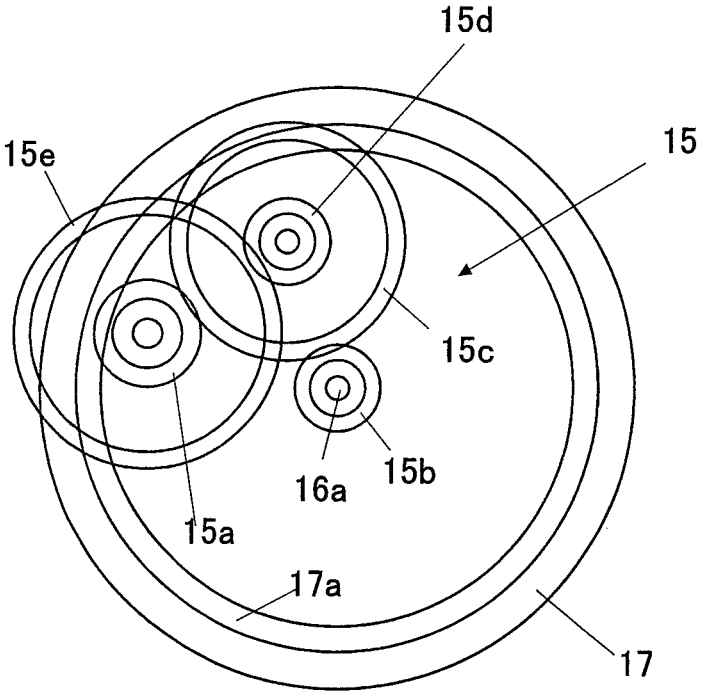
FIG. 5B is a diagram of an array of gears in the power transmission mechanism shown in FIG. 5A.

As shown in FIG. 5A and FIG. 5B, the power transmission mechanism includes a speed reducing gear train 15 assembled in a casing 13.

Figure 4:
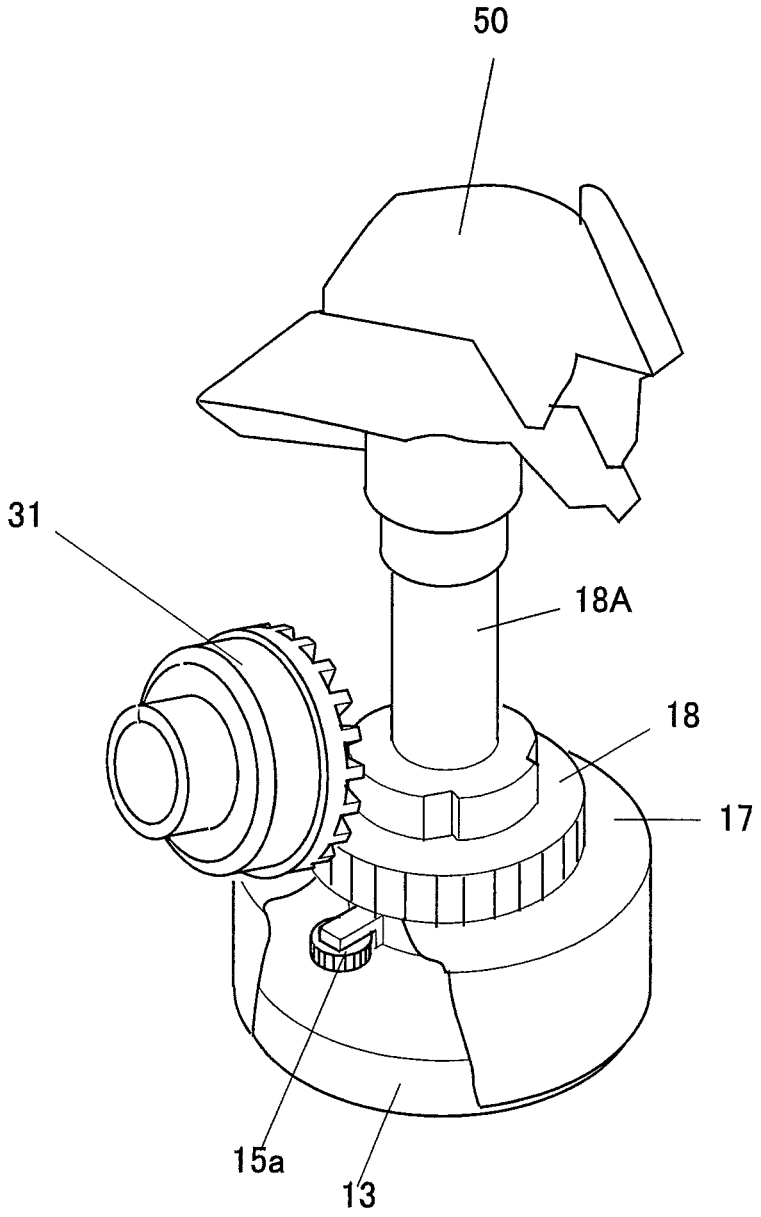
FIG. 4 is a perspective view showing a portion of a power transmission mechanism of a robot toy main body.

In the speed reducing gear train 15, a pinion 15*b* fixed to an axis 16*a* of a motor 16 is meshed to a large diameter gear 15*c*, a small diameter gear 15*d* fixed to the same axis as the large diameter gear 15*c* is meshed to a large diameter gear 15*e*, and a final gear 15*a* is fixed to the same axis as the large diameter gear 15*e*. The final gear 15*a* of the speed reducing gear train 15 is externally exposed from the casing 13 as shown in FIG. 4.

The final gear 15*a* is meshed to the internal gear 17*a* formed in the inner perimeter face of the rotating disk 17.

Therefore, the power of the motor 16 is reduced by the speed reducing gear train 15, and the rotating disk 17 is rotated through the final gear 15*a*. The rotation of the rotating disk 17 is used for operating the torso portion 20, the arm portion 30, and the leg portion 40, described later.

A center portion of the casing 13 where the speed reducing gear train 15 is assembled penetrates through the rotating disk 17 and projects upward from the rotating disk 17. A projecting portion 13*a* is a cylinder, and the inside of the projecting portion 13*a* is hollow and open at the bottom. The motor 16 is provided in the hollow portion. As shown in FIG. 5A, a fixed axis 18A is provided fixed to the projecting portion 13*a*. A fixed gear 18 is formed on the fixed axis 18A.

As shown in FIG. 4, the head portion 50 is attached to the upper edge of the fixed axis 18A.

A protrusion 17*b* in a pillar shape is provided standing on the upper surface of the rotating disk 17 in a position corresponding to a back portion of the robot toy main body 1 when the rotating disk 17 is in a horizontal neutral position. A recess portion 18*b* is formed in the torso portion 20 supported rotatable in the horizontal direction with respect to the hip portion 10 and is engaged to the protrusion 17*b*. When the rotating disk 17 rotates, the protrusion 17*b* presses the edge of the recess portion 18*b* and the torso portion 20 is rotated in the same direction as the rotating disk 17.

Figure 6A:
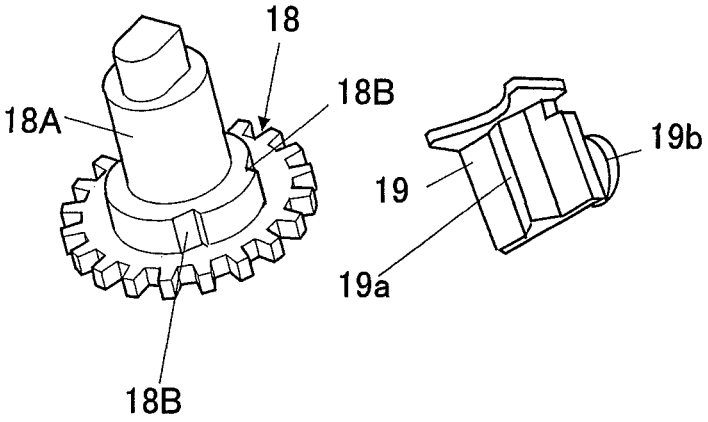
FIG. 6A is an exploded perspective view showing a reverse rotation prevention mechanism of a robot toy main body.
Figure 6B:
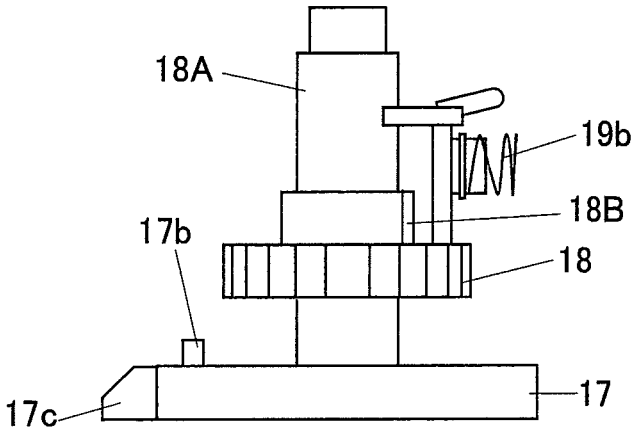
FIG. 6B is an assembly diagram of a reverse rotation prevention mechanism shown in FIG. 6A.

As shown in FIGS. 6A and 6B, two notches 18B are formed in the fixed axis 18A separated from each other a predetermined distance in the perimeter direction in a portion directly above the fixed gear 18. A latching member 19 is attached to the inner face side of the torso portion 20. A latching piece 19*a* is formed in the latching member 19 to engage to the notch 18B. The latching member 19 is attached to the torso portion 20 so that the latching piece 19*a* faces the fixed axis 18A and is connected with pressure to the fixed axis 18A by the spring 19*b*. These compose the reverse rotation prevention mechanism.

Figure 10:
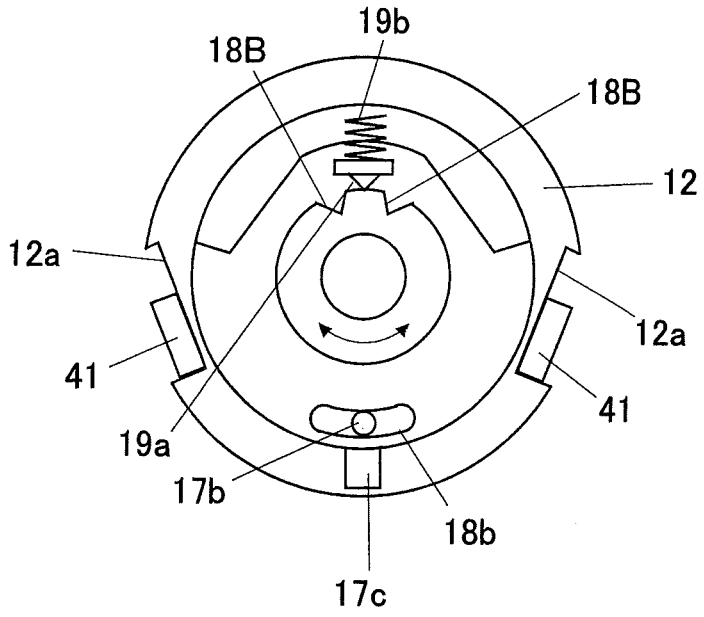
FIG. 10 is a plan view showing a rotating disk and a torso portion of a robot toy main body in a neutral position.

The rotating range of the torso portion 20 is limited by, for example, a part of the rotating disk 17 or the torso portion 20 coming into contact with a stopper (not shown) provided in the hip portion 10. According to the present embodiment, as shown in FIG. 10, the range is limited by a lever 41 being stored in a cut-out 12*a* formed on both side faces of the base 12 of the hip portion 10 and striking the edge of the cut-out 12*a*. By limiting the rotating range, the position where the torso portion 20 is twisted maximum to the right side and the position where the torso portion 20 is twisted maximum to the left side is decided. At this position, the latching piece 19*a* engages to one of the two notches 18B and the reverse rotation of the torso portion 20 is held. The hold of reverse rotation of the torso portion 20 is released when the torso portion 20 rotates in the reverse direction with the motor 16.

Figure 8:
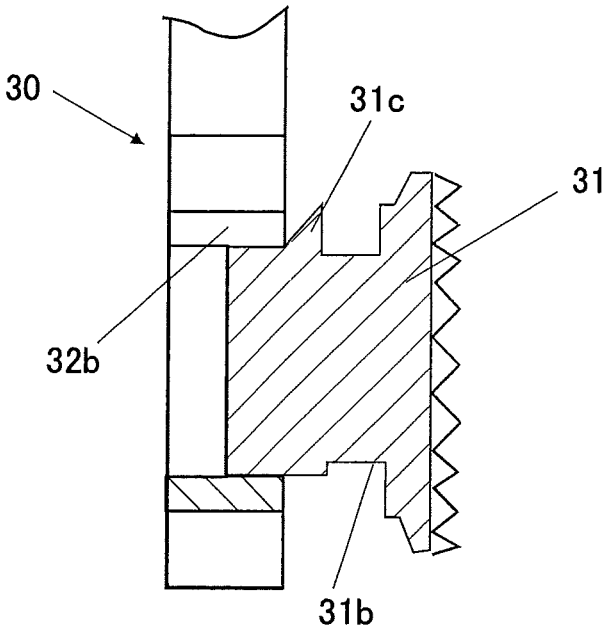
FIG. 8 is a diagram showing a portion of an assembly configuration of an arm portion of a robot toy main body.

As shown in FIG. 3, the fixed gear 18 is meshed with the crown gear 31. The crown gear 31 is attached to the torso portion 20. Specifically, as shown in FIG. 8, a circular recess portion 31*b* is formed in an axis portion 31*a* of the crown gear 31 to be concentric to the axis portion 31*a*. The circular recess portion 31*b* is held rotatable between the front portion cover 20*a* and the rear portion cover 20*b* and with this, the crown gear 31 is attached to the torso portion 20. Alternatively, a boss can be provided in a portion corresponding to the right shoulder on the inner side of the torso portion 20 and a position which does not disturb the rotation of the torso portion 20. A rivet made of iron, etc. can be provided in the crown gear 31 to penetrate a center of rotation of the crown gear 31 from the outside toward the inside. This rivet can be hit in the boss in the torso portion 20 to attach the crown gear 31 to the torso portion 20. In this attached state, the crown gear 31 is meshed to the fixed gear 18 and the crown gear 31 rotates itself while rotating around the fixed gear 18 together with the rotation of the torso portion 20.

Figure 7A:
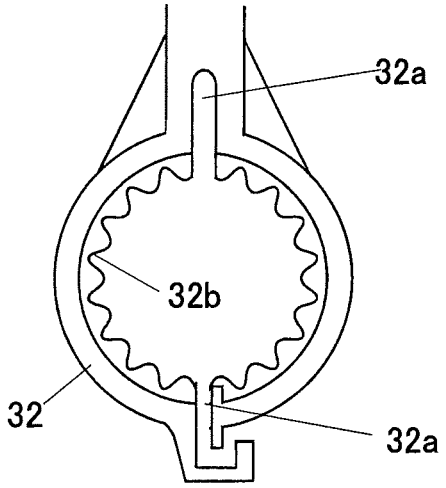
FIG. 7A is a diagram describing a base unit of an arm portion.
Figure 7B:
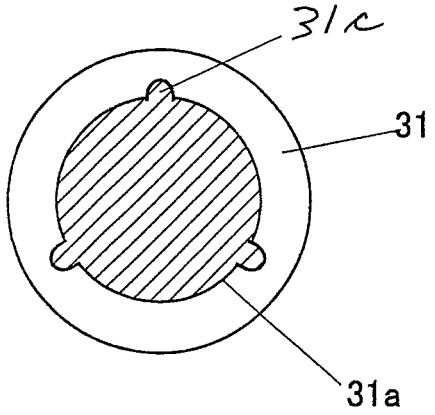
FIG. 7B is a diagram describing a base unit of a crown gear.

Then, as shown in FIG. 7B, at least one (in the present embodiment, three) bump portion 31*c* is formed on an outer perimeter in the portion projecting outside from the torso portion 20 of the axis portion 31*a* of the crown gear 31. As shown in FIG. 7A, a base portion 32 of the arm portion 30 is formed in a circular shape. A slit 32*a* is formed in the base portion 32, and with this, the base portion 32 can be enlarged easily to open in the radius direction by elasticity. A large number of recess portions 32*b* are formed in a perimeter direction in the inner perimeter face of the base portion 32.

Then, as shown in FIG. 8, the axis portion 31*a* of the crown gear 31 is fitted by pressing into the base portion 32 of the arm portion 30. In this case, when the user desires to adjust the position of the rotating direction of the arm portion 30, the base portion 32 is forcibly rotated. With this, the base portion 32 is enlarged by being deformed elastically and rotates past the bump portion 31*c* of the crown gear 31. Another recess portion 32*b* fits to the bump portion 31*c* and is latched there.

In this case, it is preferable to set the number of teeth of the crown gear 31 and the number of recess portions 32*b* of the inner perimeter face of the base portion 32 to a same number or to set the number of recess portions 32*b* of the inner perimeter face of the base portion 32 to a multiple number of the number of teeth of the crown gear 31. It is preferable that the number of recess portions 32*b* of the inner perimeter face of the base portion 32 is an integral multiple number of the bump portion 31*c*. With this, it is possible to suitably adjust the initial position of the arm portion 30. If this is not suitably adjusted, it is not possible to fully swing down the sword A.

Figure 9A:
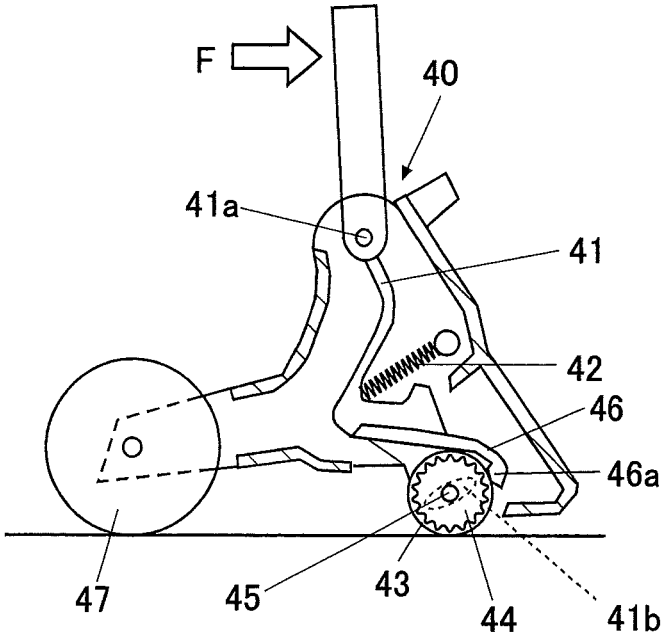
FIG. 9A is a cross-sectional view showing an initial state of a leg portion of a robot toy main body.
Figure 9B:
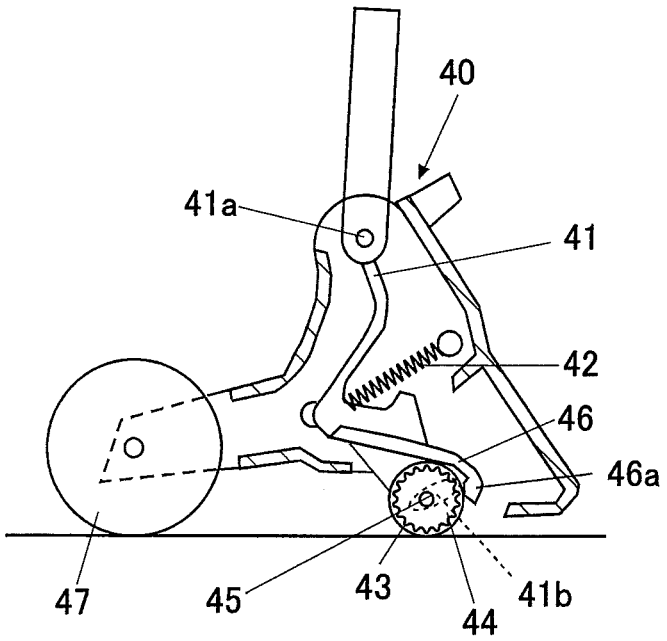
FIG. 9B is a cross-sectional view showing a movement state of a leg portion of a robot toy main body.

The leg portion 40 is provided on both side portions of the hip portion 10. Inside the leg portion 40, as shown in FIG. 9A and FIG. 9B, the lever 41 extends in the vertical direction. This lever 41 is supported in a central portion to be able to rock with the axis 41*a* as the center. This lever 41 is biased in the counterclockwise direction as shown in FIG. 9A with the spring 42.

A front wheel 43 is attached to the lower half portion of the lever 41. A ratchet wheel 44 is attached to the inner face of the front wheel 43 as one with the same axis. An axis 45 of the front wheel 43 and the ratchet wheel 44 is inserted in a long hole 41*b* formed on a lower edge portion of a lever 41, and the axis 45 is movable and rotatable in the long hole.

A pawl member 46 is attached to a bottom portion of the lever 41. A pawl 46*a* of the pawl member 46 is provided opposing to the ratchet wheel 44.

A rear wheel 47 is provided in a rear edge bottom portion of the leg portion 40.

In the initial position, an upper edge of the lever 41 is positioned to the rear by the bias force of the spring 42 (FIG. 9A). In this position, when the force F is applied to the upper edge of the lever 41 from the rear, the lever 41 resists the bias force of the spring 42 and rotates around the axis 41*a* as the center in a clockwise direction as shown in the diagram. Here, the front wheel 43 is pressed hard against the floor, the axis 45 of the front wheel 43 moves in a direction of the pawl 46*a* of the pawl member 46 in the long hole 41*b*, and the pawl 46*a* of the pawl member 46 meshes with the teeth of the ratchet wheel 44 to lock the front wheel 43. As a result, with the operation of the lever 41, the front wheel 43 kicks the floor, and the leg portion 40 corresponding to the lever 41 moves forward (see FIG. 9B).

Then, when the force F applied to the upper edge of the lever 41 is removed, the lever 41 rotates around the axis 41*a* as the center with the bias force of the spring 42 in a counterclockwise direction as shown in the drawing. Here, the movement of the axis 45 of the front wheel 43 becomes later than the movement of the pawl 46*a* of the pawl member 46 by the long hole 41*b*, the pawl 46*a* of the pawl member 46 releases the mesh with the teeth of the ratchet wheel 44 so that the front wheel 43 becomes free, the front wheel 43 rolls and the leg portion 40 corresponding to the lever 41 maintains a stopped state.

The front wheel 43 and the ratchet wheel 44 are supported by an axis at the long hole 41*b*, and the pawl 46*a* of the pawl member 46 is opposed to the teeth of the ratchet wheel 44. With this, a one-way clutch mechanism is configured and the robot toy main body 1 can run effectively.

The lever 41 operates by the rotation of the rotating disk 17. As shown in FIG. 10, the lever 41 is stored in the cut-out 12*a* formed on both side faces of the base 12 of the hip portion 10. As shown in FIG. 6B and FIG. 10, protrusion 17*c* which is a contact portion for operating the lever is formed in the perimeter face of the rotating disk 17. When the rotating disk 17 is rotated, the lever 41 is pressed by the protrusion 17*c* and the lever 41 resists to the bias force of the spring 42 and is operated.

Next, the internal configuration of the controller C is described.

Figure 12:
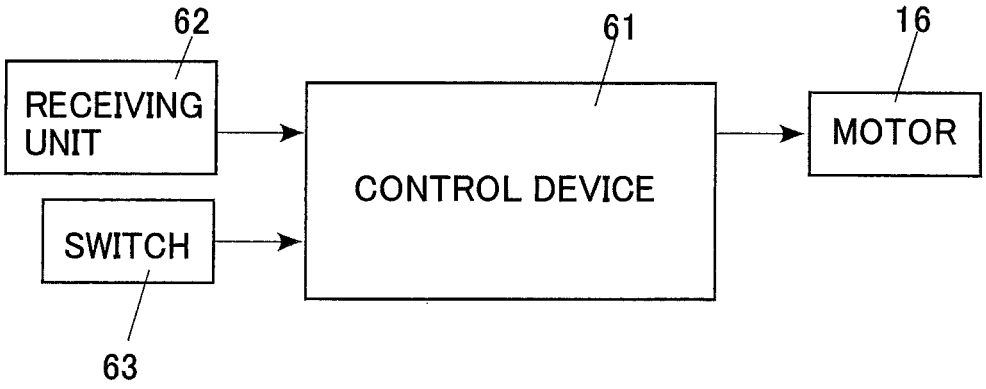
FIG. 12 is a block diagram showing a circuit configuration of a robot toy main body.

A circuit configuration of the robot toy main body 1 is shown in FIG. 12. The robot toy main body 1 includes a control device 61, a receiving unit 62, a power source switch 63, and the motor 16. The control device 61 obtains an operation control signal from the controller C through the receiving unit 62, and controls operation of the robot toy main body 1 through the motor 16 based on the operation control signal.

Specifically, the control device 61 swings the sword A or moves the leg portion 40 forward according to how the user swings the controller C. Here, after the control device 61 operates the motor 16 for an amount of time that power is necessary, the motor 16 is stopped.

<Configuration of Controller C>

Figure 13:
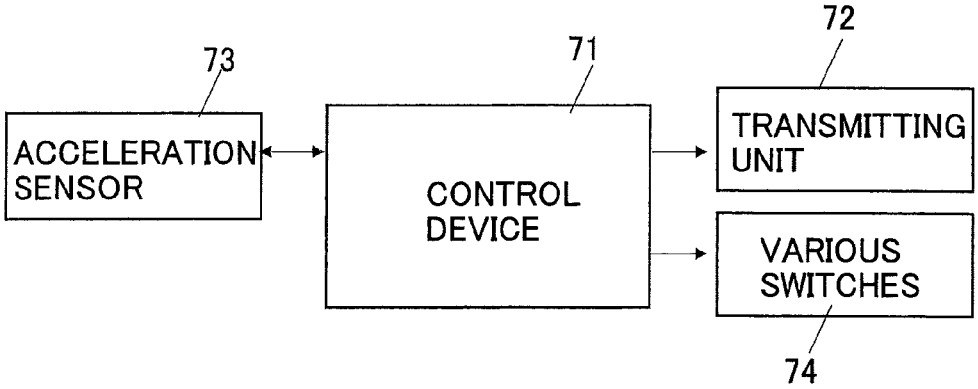
FIG. 13 is a block diagram showing a circuit configuration of a controller.

As shown in FIG. 13, the controller C includes a control device 71, a transmitting unit 72, an acceleration sensor 73, and various switches 74.

According to a program, the control device 71 judges how the user swings the controller C based on a signal detected by the acceleration sensor 73. Then, the control device 71 controls the transmitting unit 72 to transmit an operation control signal according to how the swing is to the robot toy main body 1. Alternatively, the control device 71 can transmit the operation control signal from the transmitting unit 72 to the robot toy main body 1 according to operation of the various switches 74, regardless of whether the user swings the controller C.

The controller C can also include a speaker. In this case, according to a program, the control device 71 can output sound from the speaker when the robot toy main body 1 moves forward or when the user swings the sword A.

The controller C can also include a charger for the robot toy main body 1.

<Details of Operation of Robot Toy Main Body>

The robot toy main body 1 of the present embodiment operates as described below.

In the robot toy main body 1, when the user swings the controller C, the robot toy main body 1 operates based on how the swing is.

In other words, when the user largely swings down the controller C, the movement is detected by the acceleration sensor 73 included in the controller C, and the motor 16 of the robot toy main body 1 rotates the rotating disk 17 in a counterclockwise direction from a planar view.

Figure 11A:
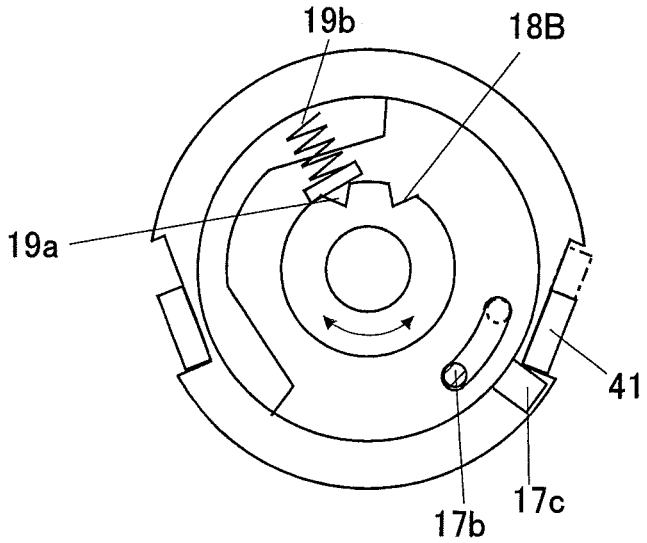
FIG. 11A is a diagram describing operation of an operation mechanism of a lever shown in FIG. 10.

Then, as shown in FIG. 11A, in the robot toy main body 1, the protrusion 17*c* presses the right side lever 41, moves the upper edge portion of the right side lever 41 to the front (shown by an alternate short and long dash line), and with this, the right side leg portion 40 moves forward one step. During the above, the torso portion 20 rotates with the protrusion 17*b* of the rotating disk 17, and the crown gear 31 rotates around the fixed gear 18 while rotating itself. With this, the sword A is swung down. In this case, since the torso portion 20 rotates and the sword A is swung down, the sword A is swung down diagonally when viewed from the front. When a predetermined amount of time passes, the motor 16 is stopped.

When the motor 16 is stopped, since the force F pressing the lever 41 is released, the lever 41 returns to the initial position by the bias force of the spring 42 of the leg portion 40. With this, the lever 41 presses the protrusion 17*c* and the rotating disk 17 is reversely rotated. Here, the protrusion 17*b* of the rotating disk 17 rotates reversely with the rotating disk 17 as shown by the solid line in FIG. 11A. However, since the protrusion 17*b* moves only within the recess portion 18*b*, the torso portion 20 where the recess portion 18*b* is formed does not return.

Figure 11B:
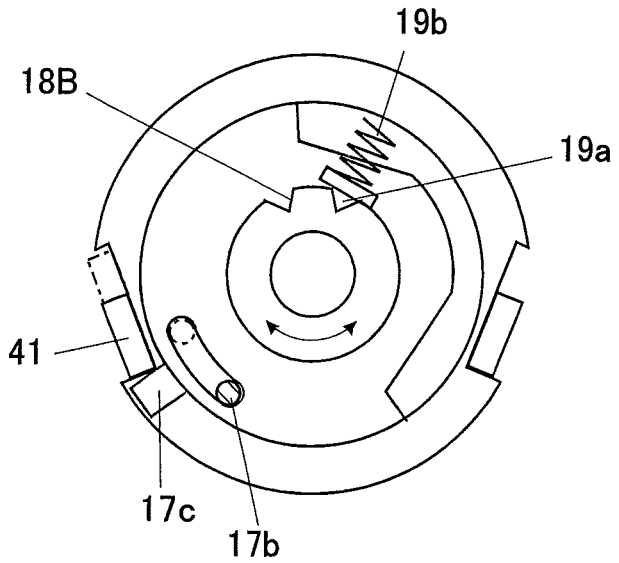
FIG. 11B is a diagram describing operation of an operation mechanism of a lever shown in FIG. 10.

When the swung down controller C is swung up, the motor 16 rotates reversely. When the motor 16 rotates reversely, the rotating disk 17 rotates in the clockwise direction from a planar view. Then, as shown in FIG. 11B, the torso portion 20 rotates in the clockwise direction, the protrusion 17*c* comes into contact with the left side lever 41, the upper edge portion of the left side lever 41 is moved forward (shown with a short and long dash line) and the left side leg portion 40 moves one step. During the above, the torso portion 20 rotates through the protrusion 17*b* of the rotating disk 17, and the crown gear 31 rotates around the fixed gear 18 while rotating itself. With this, the sword A is swung up. When a predetermined amount of time passes, the motor 16 is stopped.

In this case also, when the motor 16 stops, since the force F pressing the lever 41 is released, the lever 41 returns to the initial position by the bias force of the spring 42 of the leg portion 40. With this, the lever 41 presses the protrusion 17*c* and the rotating disk 17 is reversely rotated. Here, the protrusion 17*b* of the rotating disk 17 rotates reversely with the rotating disk 17 as shown by the solid line in FIG. 11B.

However, since the protrusion 17*b* moves only within the recess portion 18*b*, the torso portion 20 where the recess portion 18*b* is formed does not return.

In the robot toy main body 1, when the user makes a small swing of the controller C in a state where the tip of the controller C is pointing down, the rotating disk 17 rotates in the counterclockwise direction from a planar view from the state of the protrusion 17*b* in a solid line as shown in FIG. 11A. Therefore, again, the protrusion 17*c* presses the right side lever 41 to move the upper edge portion of the right side lever 41 forward (shown with alternate long and two short dash line), and with this, the right side leg portion 40 moves forward one step. When the user makes a small swing of the controller C in a state where the tip of the controller C is pointing up, the rotating disk 17 rotates in the clockwise direction from a planar view from the state of the protrusion 17*b* in a solid line as shown in FIG. 11B. Therefore, again, the protrusion 17*c* presses the right side lever 41 to move the upper edge portion of the left side lever 41 forward (shown with alternate long and short dash line), and with this, the left side leg portion 40 moves forward one step.

Embodiments of the present invention are described above, however, the present invention is not limited to the above embodiments, and various modifications are possible without changing the scope of the present invention.

For example, the present embodiment is a robot toy main body 1 which swings down and swings up a sword A. However, the present invention can be applied to a robot toy body which brings out and pulls back its fist, a robot toy body which slaps like a sumo wrestler or toy main bodies other than a robot toy main body.

According to the present embodiment, only the right side arm portion 30 moves together with the motor 16 through the crown gear 31 and the left side arm portion 30 follows. However, both arm portions 30 can move together with the motor 16. In this case, each arm portion 30 can move individually, and it is possible to make a robot toy main body such as a robot toy main body which can use two swords, or a robot toy main body which can do dance movements.

According to the above embodiment, the torso portion 20 is supported rotatable with respect to the hip portion 10 and the arm portion 30 is supported rotatable with respect to the torso portion 20. However, the arm portion 30 can be fixed to the torso portion 20.

The present invention can be suitably used in the field of manufacturing toys such as a robot toy.

The invention claimed is:

1. A toy, comprising:

a motor that rotates in forward and reverse directions;

a movable torso having a base in which is formed only one recess portion, wherein the only one recess portion has a predetermined length in a moving direction of the torso, and wherein the torso moves by rotating reversely around a vertical first axis;

at least one arm connected to the torso and movable by the motor;

a first leg below the torso that is movable between a first initial position and a second, extended position;

a second leg below the torso that is movable between a first initial position and a second, extended position;

a spring to normally bias the first leg into the initial position;

a spring to normally bias the second leg into the initial position;

a rotating disk which rotates in first and second directions around the first axis when the motor rotates in the forward and reverse directions, respectively, wherein the rotating disk includes:

a contact portion which selectively presses only the first leg or the second leg according to the rotating direction of the rotating disk to move the respective pressed first or second leg from the first initial position into the second, extended position against the bias force, but the torso and the arm do not move; and only one protrusion which is loosely fitted in the only one recess portion and movable between a first position in the only one recess portion, wherein only the torso is rotated and the arm moved, and a second position in the only one recess portion, wherein the torso, arm and only one of the first or second legs is moved, wherein, in the first position, the only one protrusion presses an edge of the only one recess portion to rotate only the torso in a rotating direction of the rotating disk, wherein, in the second position the only one protrusion does not press the edge of the only one recess portion unless the first leg or the second leg has been returned to the initial position, wherein each of the first leg and the second leg is provided with a propulsion mechanism having a wheel to kick a support surface so that the respective first or second leg moves forward, the propulsion mechanism including:

a lever which extends in a substantially vertical direction at each of the first leg or the second leg and which is supported rotatably by a second axis so that a lower edge portion of the lever moves in a frontward and rearward direction;

the wheel is provided at the lower edge portion of the lever;

a one-way clutch mechanism which locks the wheel when the lower edge portion of the lever moves in the rearward direction and which releases the lock of the wheel when the lower edge portion of the lever moves in the forward direction; and the spring biases the lever so that the lower edge portion of the lever is biased in the frontward direction, and wherein the contact portion of the rotating disk presses an upper edge portion of the lever of only one of the first leg or the second leg according to the first or second rotating direction of the rotating disk and moves the lever against the bias force of the spring to move the pressed leg into the second, extended position; and a reverse rotation prevention mechanism connected to the torso to prevent reverse rotation of the torso in a position where the lower edge portion of the lever finishes moving in the rearward direction, and until the motor reversely rotates the torso.

2. The toy as recited in claim 1, further comprising:

a fixed gear in the torso; and a crown gear provided at the arm, wherein the crown gear meshes with the fixed gear and rotates with the fixed gear and a rotation of the torso so that the arm moves.

3. The toy as recited in claim 2, further comprising, an engaging portion on the crown gear includes at least one of a bump portion or at least one of a recess portion; and an engaging portion on the arm includes the other of the at least one bump portion or the at least one recess portion to engage the one of the at least one bump portion or the at least one recess portion of the crown gear engaging portion, wherein a number of the at least one bump portion or a number of the at least one recess portion is a same number as a number of teeth of the crown gear or a multiple of the number of teeth of the crown gear.

4. The toy as recited in claim 2, wherein a sword is attached to a hand of the arm.

* * * * *